United States Patent [19]

Cobe, Jr.

[11] Patent Number: 4,597,123

[45] Date of Patent: Jul. 1, 1986

[54] COMBINATION FIREFIGHTER'S TOOL

[76] Inventor: Walter T. Cobe, Jr., 154 Dwelley Ave., Hanover, Mass. 02339

[21] Appl. No.: 742,976

[22] Filed: Jun. 10, 1985

[51] Int. Cl.[4] ..... B25F 1/00; B25B 13/48

[52] U.S. Cl. ..... 7/138; 7/147; 7/166; 81/176.1

[58] Field of Search ..... 81/176.1; 7/169, 143, 7/138, 146, 147, 166

[56] References Cited

U.S. PATENT DOCUMENTS

| | | | |
|---|---|---|---|
| 297,838 | 4/1884 | Parsons | 7/156 |
| 845,975 | 3/1907 | Patterson . | |
| 968,106 | 8/1910 | Zimmermann . | |
| 1,527,772 | 2/1925 | Baird . | |
| 1,627,435 | 5/1927 | Hooben | 81/176.1 |
| 1,647,576 | 11/1927 | Nowka et al. . | |
| 1,703,856 | 2/1929 | McKeag . | |
| 1,752,074 | 3/1930 | Gagne . | |
| 2,087,148 | 7/1937 | Hempy . | |
| 2,360,163 | 10/1944 | Sadler | 81/176.1 |
| 2,420,458 | 5/1947 | Barker | 81/176.1 |

FOREIGN PATENT DOCUMENTS 186662 10/1922 United Kingdom .

OTHER PUBLICATIONS

Design—No. 35,446, Patented Dec. 17, 1901, J. L. Clements.

*Primary Examiner*—Roscoe V. Parker

*Attorney, Agent, or Firm*—Kenway & Jenney

[57] ABSTRACT

The tool includes an elongate handle one end of which tapers into a wedge shape useful for prying. The other end of the elongate handle includes an arcuate portion with inwardly angled projections creating a spanner wrench for use with hose couplings. One side of the arcuate portion includes a cylindrical member with a flat face suited for a hammering operation. The other end of the arcuate portion includes claw members diverging from a narrow portion proximal the arcuate member and cooperates with the arcuate member in a prying operation. A pin member extends in a plane perpendicular to the plane formed by the elongate handle and the arcuate member and is located for use in removing hinge pins from doors.

4 Claims, 6 Drawing Figures

COMBINATION FIREFIGHTER'S TOOL

BACKGROUND OF THE INVENTION

The present invention relates to a firefighter's tool, and more particularly to a combination firefighter's tool capable of performing the functions of a spanner wrench, a hammer, crowbar, prying implement, and a tool for removing hinge pins from doors.

Firefighters are often confronted with unpredictable situations which heretofore would require several different tools. Firefighters are commonly faced with the problem of gaining entry into burning buildings or burning vehicles such as cars and trucks. Gaining entry into buildings often requires a prying action to dislodge members from doorways and windows. A hammering action is also required for breaking out windows to gain entry. Gaining entry into locked automobile trunks and passenger compartments requires a tool first to dislodge the lock cylinder with subsequent turning to open the lock. Futhermore, when a solid door in a building is encountered, removal of the hinge pins is often the most effective way of opening such a door. After entering a building, it is often necessary to turn off the gas supply to appliances.

In addition to the variety of firefighter's tools needed for gaining entry into buildings and motor vehicles, firefighters use spanner wrenches for coupling and uncoupling hoses. Spanner wrenches generally have an arcuate portion with projections which fit into notches in the hose couplings. A common spanner wrench is disclosed in U.S. Pat. No. 2,420,458. Other spanner wrenches are taught in U.S. Pat. Nos. 1,627,435 and 2,360,163. U.S. Pat. No. 297,838 discloses a combined household implement for opening jars and including a hammer and claw portion for driving and pulling tacks. None of the known tools, however, allows a firefighter to gain entry into buildings and cars requiring a prying action, or the removal of door hinge pins, while at the same time incorporating a spanner wrench for coupling and decoupling hoses.

It is therefore an object of the present invention to provide a combination firefighter's tool which includes a spanner wrench portion, members for prying and apparatus for removing hinge pins.

Yet another object of the invention is a combination tool including diverging claw members suitable for turning off gas valves.

Still another object of the invention is a combination tool which is compact and well balanced for the hammering, prying and spanner wrench operations.

SUMMARY OF THE INVENTION

The firefighter combination tool disclosed herein includes an elongate handle with first and second ends, the first end of which tapers into a wedge shape. An arcuate spanner wrench portion is affixed to the second end of the handle and includes inwardly angled projections extending from opposite ends of the arcuate portion. A substantially cylindrical member is affixed to one of the ends of the arcuate portion and has a flat face parallel to the handle member. In addition, first and second claw members depend from the other end of the arcuate member. These claw members diverge from a narrow separation near the arcuate member and extend in a plane formed by the elongate handle and the arcuate member. A pin extends beyond the claw members in a direction perpendicular to the plane formed by the handle and the arcuate member and is located between the narrow separation of the claw members and the arcuate member.

BRIEF DESCRIPTION OF THE DRAWING

The invention disclosed herein will be better understood with reference to the drawing in which.

DESCRIPTION OF THE PREFERRED EMBODIMENT

Figure 1:
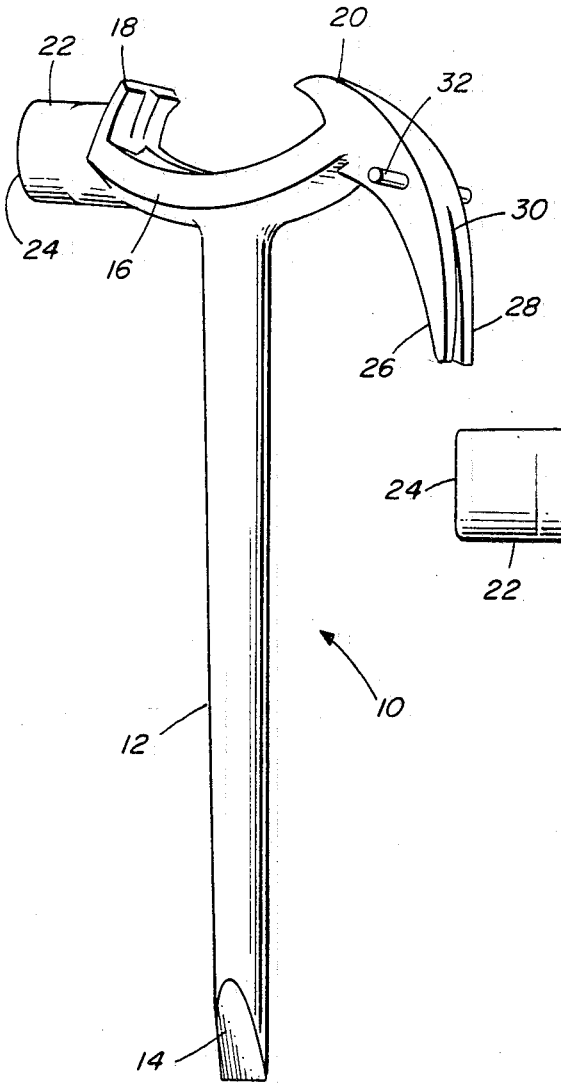
FIG. 1 is a perspective view of the tool disclosed herein.
Figure 2:
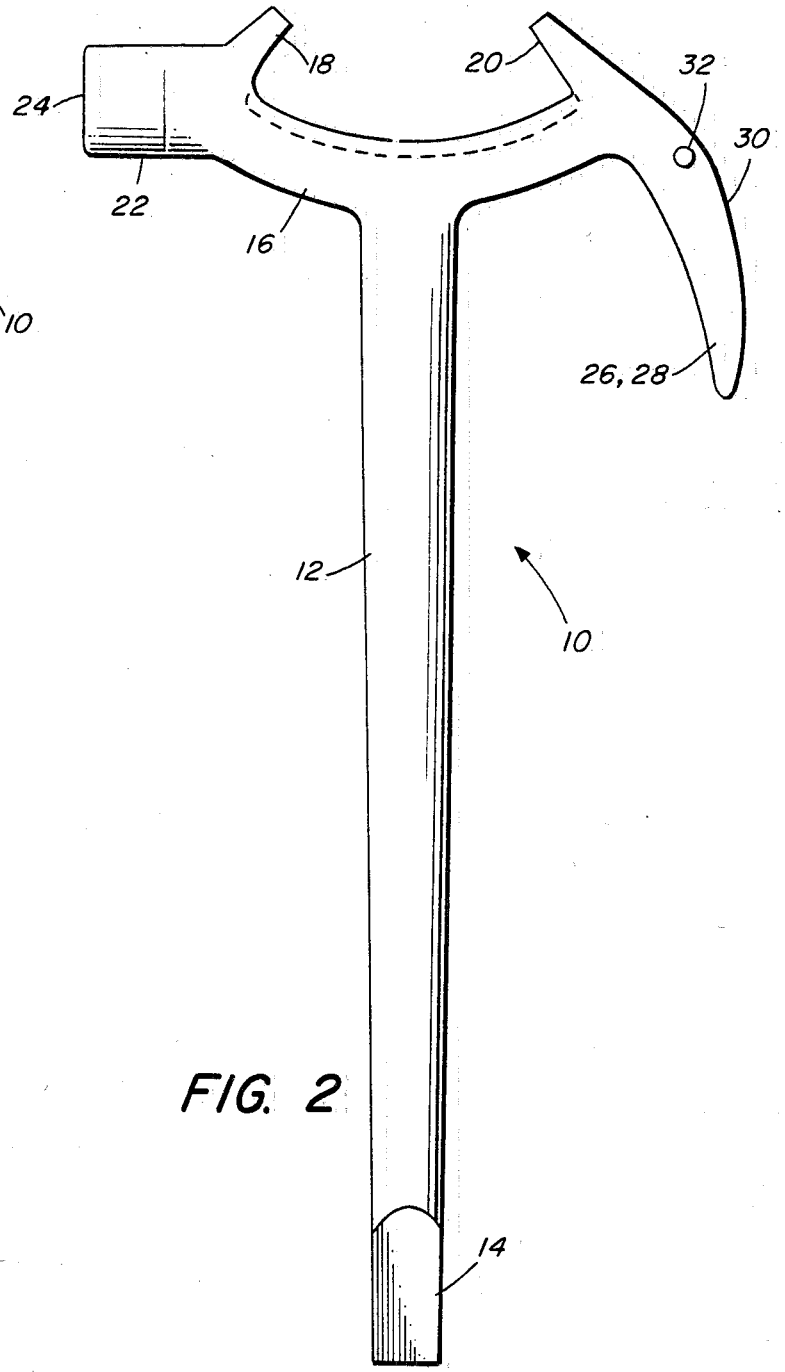
FIG. 2 is a plan view of the tool.

With reference first to FIGS. 1 and 2, a combination firefighter's tool 10 includes an elongate handle 12 having a first end 14 which tapers into a wedge shape. The opposite end of the handle 12 supports an arcuate member 16. The arcuate member 16 includes inwardly slanting projections 18 and 20 which cooperate with the arcuate portion 16 to form a spanner wrench. Those skilled in the art will recognize that the spanner wrench portion has utility in coupling and uncoupling hoses used in the firefighting field. Disposed at one end of the arcuate portion 16 is a cylindrical member 22 having a flat face 24 generally parallel to the length of the elongate handle 12. The flat face 24 is useful as a hammer-like device for gaining access to buildings. For example, the face 24 may be used to knock out glass from a window. The other end of the arcuate portion 16 includes a pair of claw-like members 26 and 28. The claw members 26 and 28 diverge from a narrow portion 30. A pin 32 extends through the tool substantially perpendicular to the plane formed by the arcuate member 16 and the handle 12. As will be described below, the pin 32 is useful for moving the hinge pin from a door hinge.

A perferred embodiment of the combination tool 10 has an overall length of approximately 12 inches. The handle 12 has a diameter of approximately ¾ of an inch at its upper portion near the arcuate member 16. The cylindrical member 22 with the flat face 24 has approximately a 1 inch diameter. It is preferred that the tool 10 be made of steel in a drop forging process. After forging, a hole is drilled to accommodate the pin 32 which is then pressed into position. It is preferred that the pin 32 be made of a hardened steel alloy.

Figure 3:
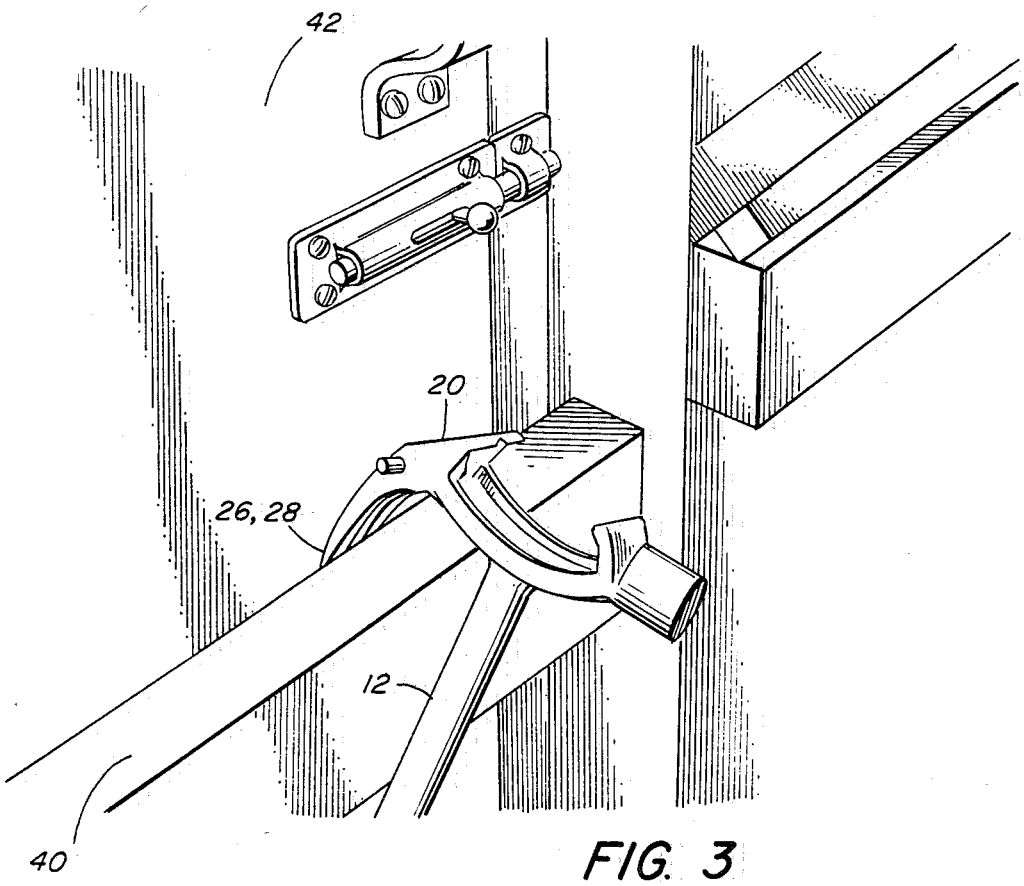
FIG. 3 illustrates the prying capability of the tool disclosed herein.

The various aspects of the combination tool's operation will now be discussed in conjunction with FIGS. 3–6. First of all, as discussed above, the arcuate portion 16 in conjunction with the projections 18 and 20 form a spanner wrench which is used in the known manner for coupling and decoupling hoses. For example, the utilization of such a spanner wrench is discussed in U.S. Pat. No. 2,420,458 mentioned earlier. In FIG. 3, the claw members 26,28 cooperate with the rear portion of the inwardly slanting projection 20 to provide a prying action. In particular, a piece of wood 40 can be removed from a doorway 42 by inserting the claw members 26,28 between the wooden member 40 and the doorway 42 and lifting on the handle 12.

Figure 4:
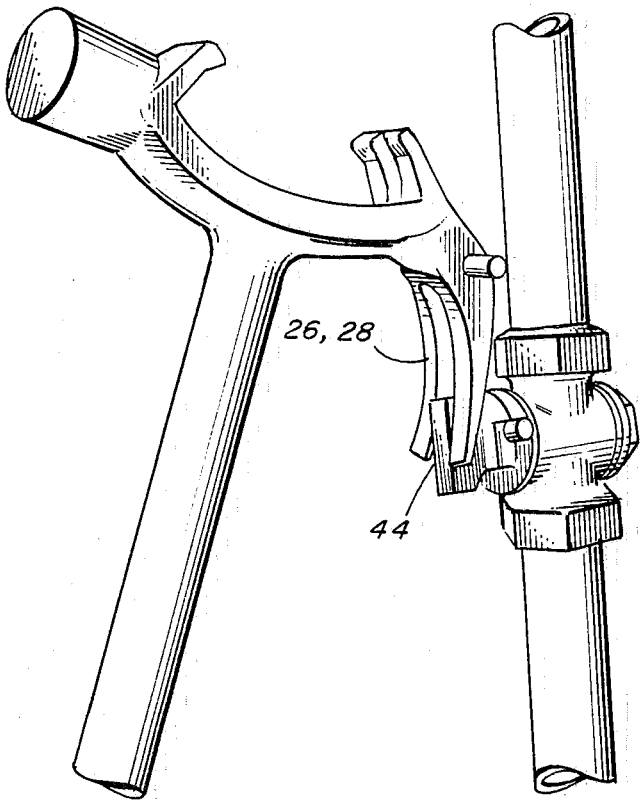
FIG. 4 illustrates the use of the tool in turning off a gas valve.

Another important function of the tool 10 is illustrated in FIG. 4. In this case, the claw members 26 and 28 are used to grasp a gas shut-off valve 44 which can then be rotated 90° to turn off a supply of gas. Such a valve 44 is commonly used with gas appliances such as stoves, clothes dryers, hot water heaters, and furnaces.

Figure 5:
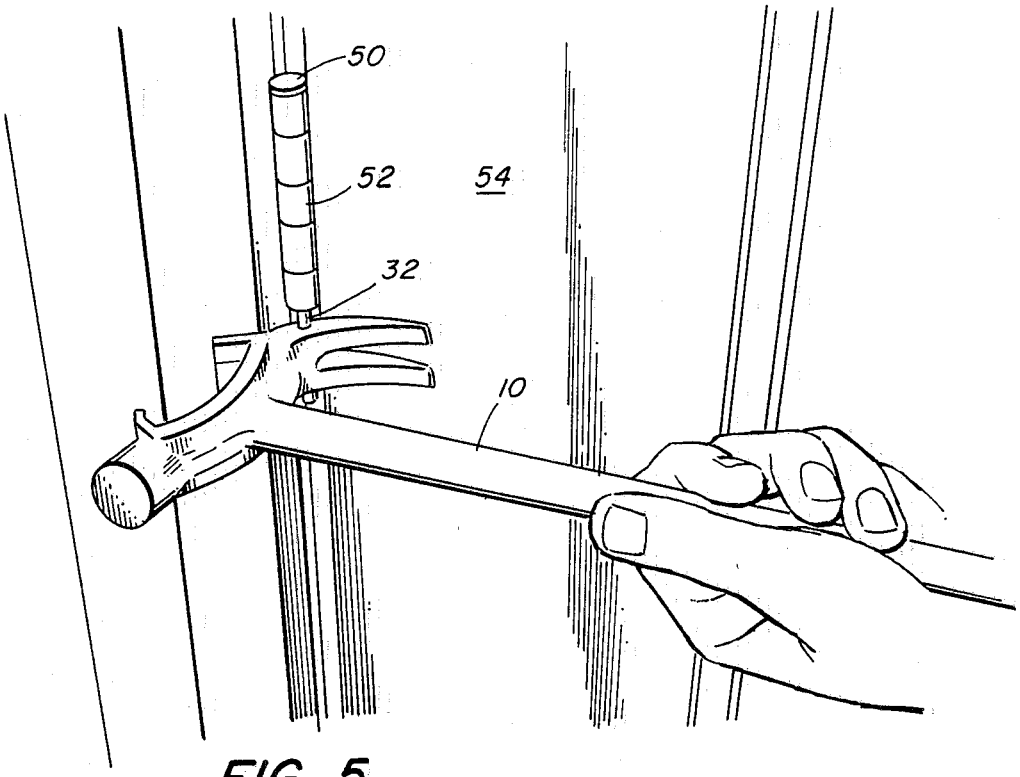
FIG. 5 shows the tool being used to remove the hinge pin from a door hinge.

Yet another important function of the tool disclosed herein is illustrated in FIG. 5. In this case, the pin 32 is used to extract a hinge pin 50 from a hinge 52 holding a door 54. It should be noted that if the hinge 52 were located on the right portion of the door portion 54 rather than on the left side as illustrated in FIG. 5, the tool 10 can be turned over to use the pin 32 extending from the other side of the tool 10. Once the hinge pin 50 has been removed from the door 54, the door 54 may be removed to permit firefighter access.

Figure 6:
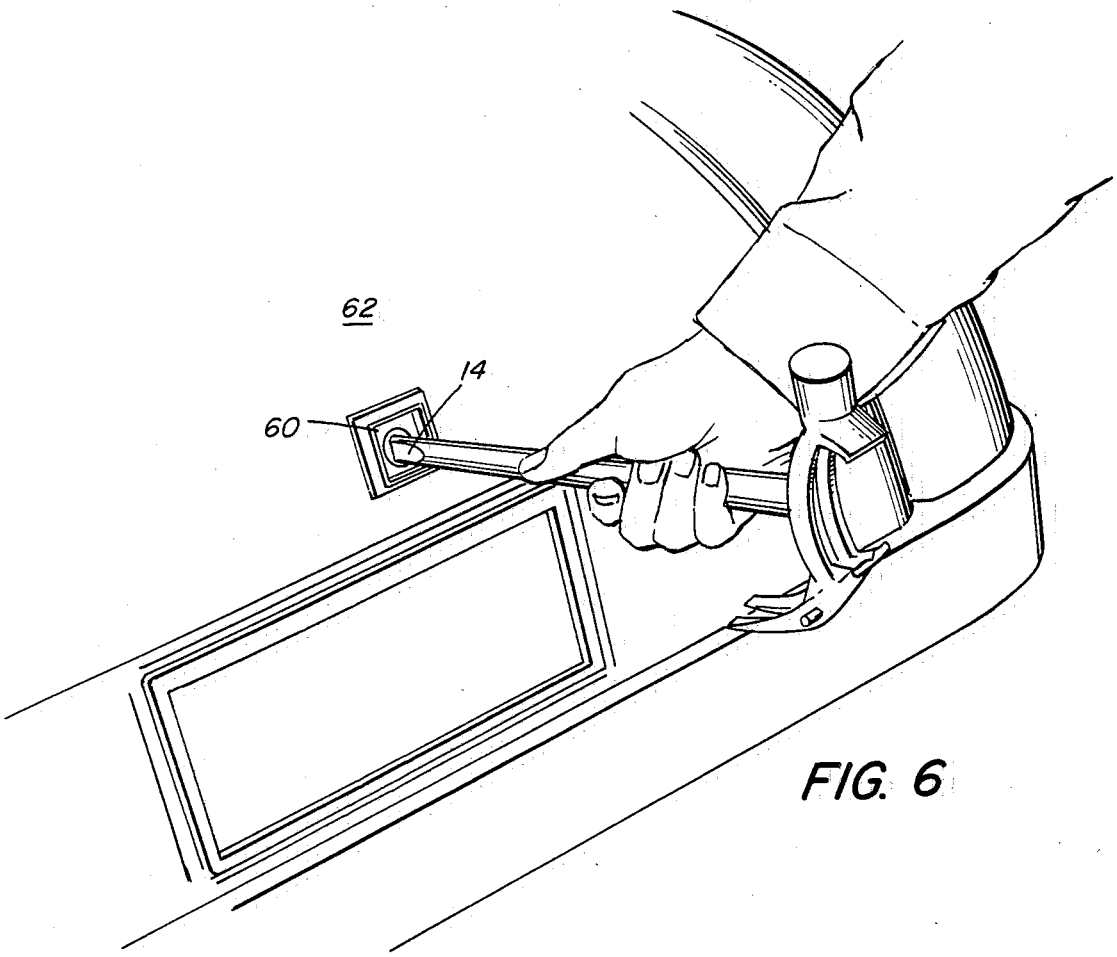
FIG. 6 illustrates the use of the wedge end of the tool for opening an automobile trunk.

Still another important function of the firefighter tool disclosed herein is shown in FIG. 6. In this situation, the wedge end 14 of the tool 10 is inserted into a lock 60 of a motor vehicle 62. In this case, the wedge end 14 is used to knock the trunk lock cylinder out. The wedge is then inserted into the remaining hole and turned approximately 90° to release the trunk lid.

It is thus seen that the objects of this invention have been achieved in that there has been described a combination firefighter tool which not only serves as a spanner wrench for coupling and uncoupling hose equipment, but also aids a firefighter in gaining access in emergency situations. One side of the spanner wrench portion includes claws for use in a prying fashion to gain entry through boarded up doors and windows, for example. The claws diverge so that they may be used to grip tightly a gas valve shut-off once entry into a burning building has been achieved. A hardened steel pin is provided extending perpendicularly to the plane formed by the tool handle and the spanner wrench portion which is utilized for removing the hinge pin of doors so that a door may be removed to permit access. In addition, the elongate handle terminates in a wedge shaped portion which may be used to open motor vehicle locks or as a crowbar for other prying operations. The tool also incorporates a cylindrical portion with a flat face which serves as an effective means for breaking out glass or other hammering operations. The tool disclosed herein is compact and easy to use. In addition, it is only slightly heavier than the known spanner wrenches which firemen carry. Furthermore, the tool is well balanced for ease of use.

It is recognized that modifications and variations of the firefighter tool disclosed herein will occur to those skilled in the art, and it is intended that all such modifications and variations be included within the scope of the appended claims.

What is claimed is:

1. Firefighter combination tool comprising:

an elongate handle member having first and second ends, the first end tapering into a wedge shape;

an arcuate spanner wrench portion affixed to the second end of the handle and including inwardly angled projections extending from opposite ends of the arcuate portion;

a substantially cylindrical member depending from one of the ends of the arcuate portion and having a flat face parallel to the elongate handle member;

first and second claw members depending from the other end of the arcuate member, the first and second claw members diverging from a narrow separation proximal to the arcuate member, the claw members extending in a plane formed by the elongate handle and the arcuate member and diverging in a plane perpendicular to the plane formed by the elongate handle and the arcuate member; and a pin member extending beyond the claw members in a direction perpendicular to the plane formed by the elongate handle and the arcuate member and located between the narrow separation of the claw members and the arcuate member.

2. The tool of claim 1 wherein the plane of the taper of the first end of the handle is parallel to the plane formed by the handle and the arcuate member.

3. The tool of claim 1 wherein the arcuate portion is sized for use with hose couplings.

4. The firefighter tool of claim 1 wherein the pin member is fashioned of hardened steel and press fit within the tool.

* * * * *